US010158190B1

(12) United States Patent
Sun et al.

(10) Patent No.: US 10,158,190 B1
(45) Date of Patent: Dec. 18, 2018

(54) TYPE-C CONNECTOR WITH IMPROVED PERFORMANCE

(71) Applicant: Dongguan Teconn Electronics Technology Co., Ltd., Dongguan (CN)

(72) Inventors: Hongyun Sun, Dongguan (CN); Hubin Li, Dongguan (CN); Fenghui Han, Dongguan (CN)

(73) Assignee: DONGGUAN TECONN ELECTRONICS TECHNOLOGY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/808,906

(22) Filed: Nov. 10, 2017

(51) Int. Cl.

| | |
|---|---|
| ***H01R 13/648*** | (2006.01) |
| ***H01R 13/52*** | (2006.01) |
| ***H01R 12/72*** | (2011.01) |
| ***H01R 13/405*** | (2006.01) |
| ***H01R 13/6585*** | (2011.01) |
| ***H01R 13/6594*** | (2011.01) |
| *H01R 12/70* | (2011.01) |

(52) U.S. Cl.
CPC ..... *H01R 13/521* (2013.01); *H01R 12/727* (2013.01); *H01R 13/405* (2013.01); *H01R 13/6585* (2013.01); *H01R 13/6594* (2013.01); *H01R 12/707* (2013.01)

(58) Field of Classification Search
CPC ..... H01R 13/5205; H01R 13/5208
USPC ..... 439/271, 587, 589
See application file for complete search history.

(56) References Cited

U.S. PATENT DOCUMENTS

| | | | | |
|---|---|---|---|---|
| 2015/0270646 | A1* | 9/2015 | Kao | H01R 13/6581 439/76.1 |
| 2015/0270661 | A1* | 9/2015 | Kao | H01R 13/5202 439/271 |
| 2015/0295347 | A1* | 10/2015 | Nagata | H01R 24/58 439/587 |
| 2016/0064879 | A1* | 3/2016 | Yen | H01R 24/78 439/607.01 |
| 2016/0141804 | A1* | 5/2016 | Kao | H01R 24/60 439/607.01 |
| 2016/0149350 | A1* | 5/2016 | Kao | H01R 12/724 439/607.05 |
| 2016/0156136 | A1* | 6/2016 | Kao | H01R 13/6585 439/607.05 |
| 2016/0181734 | A1* | 6/2016 | Kao | H01R 13/6585 439/607.05 |
| 2016/0204540 | A1* | 7/2016 | Chen | H01R 13/56 439/660 |

* cited by examiner

*Primary Examiner* — Abdullah Riyami
*Assistant Examiner* — Thang Nguyen
(74) *Attorney, Agent, or Firm* — Leong C. Lei

(57) ABSTRACT

A Type-c connector with improved performance includes a main insulator, a hook member, a housing, an upper row of terminals, a lower row of terminals, and a shield casing. With creepage portions integratedly extended from front ends of upper and lower insulating members of the main insulator, creepage distances between the terminals and the shield casing are increased, thereby reducing the risk of short circuit.

7 Claims, 5 Drawing Sheets

TYPE-C CONNECTOR WITH IMPROVED PERFORMANCE

BACKGROUND OF THE INVENTION

1. Technical Field

The present invention relates to electrical connectors, and more particularly to a Type-c connector with improved performance.

2. Description of Related Art

USB Type C connectors feature for their thinner profile, faster transmission and stronger power transmission. Type-C connectors allow USB interface to be inserted with either side upward, and radically eliminate the universal problem of "always misplug". Presently, USB Type C connectors have been extensively adopted, and many major manufacturers are producing products based on USB Type C connectors.

An existing USB Type-C plug connector typically comprises a main insulator, a hook member, a housing, an upper row of terminals, a lower row of terminals, and a shield casing. Such a known device, however, has some shortcomings: 1. with the hook member and the shield casing bump becoming failed, the terminals tend to have shrunk pins; 2. The creepage distances from the terminals to the shield casing and to the hook members are too small, leading to the risk of short circuit caused by electrolyte creepage; 3. the contact portions of the terminals are not retained, so the contact portions are likely to get damaged, lose springiness, and have defective contact over time.

SUMMARY OF THE INVENTION

In view of this, the primary objective of the present invention is to address the shortcomings of the prior art by providing a Type-c connector with improved performance, which effectively addresses the problems related to the prior art such as too short creepage distances from the terminals to the shield casing and to the hook member, and failure of the contact portions of the upper and lower rows of terminals that leads to short circuit caused by electrolyte creepage.

For achieving the foregoing objective, the present invention adopts the following technical schemes:

A Type-c connector with improved performance comprising a main insulator, a hook member, a housing, an upper row of terminals, a lower row of terminals, and a shield casing; the main insulator including an upper insulating member and the lower insulating member, the upper insulating member and the lower insulating member being combined together in a vertically symmetrical manner; the hook member being located between the upper insulating member and the lower insulating member, the hook member including a motherboard portion and two hook portions; the housing being assembled to a front end of the main insulator, the housing having its front end formed with a socket extending rearward, for the two hook portions to have their front ends inserted into the socket and located at two opposite sides of the socket; the upper row of terminals and the upper insulating member being fixedly combined, the lower row of terminals and the lower insulating member being fixedly combined; the shield casing enclosing the main insulator and the housing from outside; wherein:

the upper insulating member and the lower insulating member having their front ends combined by means of water seal troughs and water seal strips that are configured to fit an engage with each other, the upper insulating member and the lower insulating member having their front ends each provided with a creepage portion integratedly extended forward, the creepage portion being configured to be inserted into a rear end of the socket; each of the two hook portions having its rear end formed with a raised abutting point, the hook portions being configured to come into close fit with two opposite inner walls of the shield casing, each of the two hook portions having its rear end extended rearward to form a weld portion, the weld portions jutting out of the rear end of the main insulator and being welded with the circuit board; the socket having its front end formed with a plurality of spaced mounting tables at its upper and lower inner walls, and the contact portions at the front end of the upper row of terminals and the contact portions at the front end of the lower row of terminals abutting against the corresponding mounting tables, respectively.

As compared to the prior art, the present invention has substantial advantages and beneficial effects. Particularly, it is learned from the technical schemes that:

With the creepage portions integratedly extended from the front ends of the upper and lower insulating members, the creepage distances from the terminals to the shield casing are increased, thereby reducing the risk of short circuit caused by electrolyte creepage; with the water seal troughs and the water seal strips provided at the front end jointing surfaces of the upper insulating member and the lower insulating member to engage with each other, the creepage distances from the terminals to the hook member are increased, thereby reducing the risk of short circuit caused by electrolyte creepage; with the abutting points provided at the rear ends of the two hook portions of the hook member to form hard interference with the shield casing, stable contact between the hook member and the shield casing is ensured; with the mounting tables spaced in the front end of the housing socket for the contact portions of the upper and lower rows of terminals to abut against, the upper and lower rows of terminals are preloaded, making the terminals spring up uniformly, so as to prevent pin breakage that would otherwise happen during male-female connection due to exposure of terminals.

DETAILED DESCRIPTION OF THE INVENTION

Figure 1:
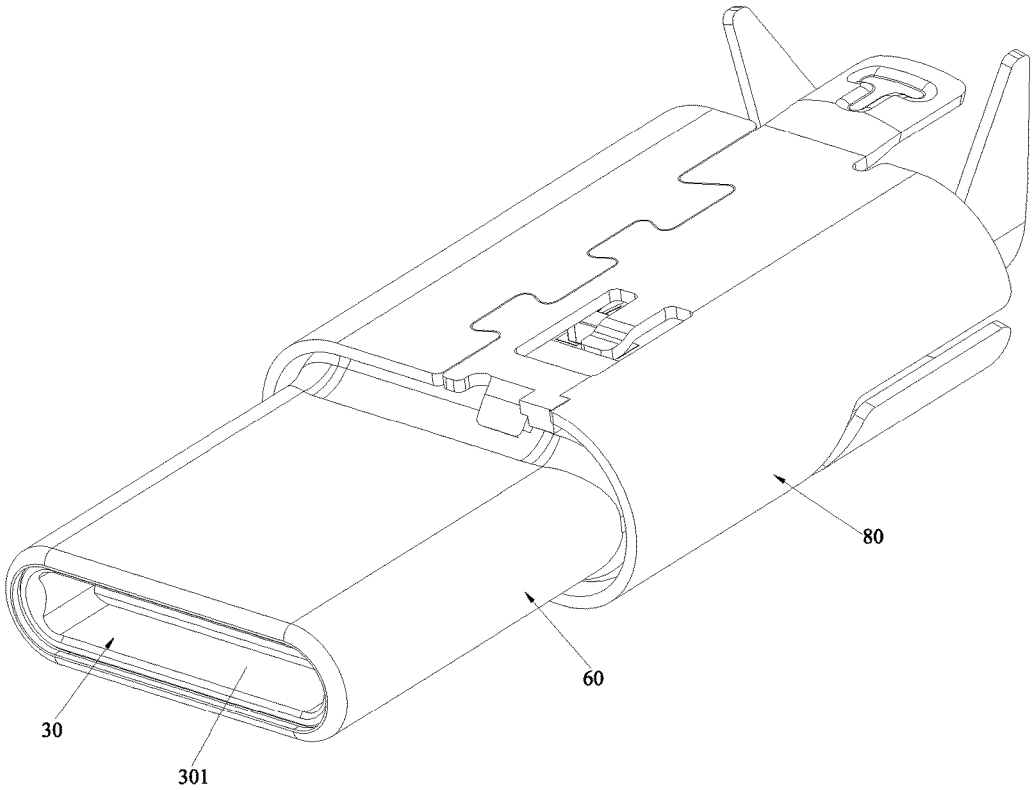
FIG. 1 is a perspective view of a Type-c connector according to a preferred embodiment of the present invention.
Figure 2:
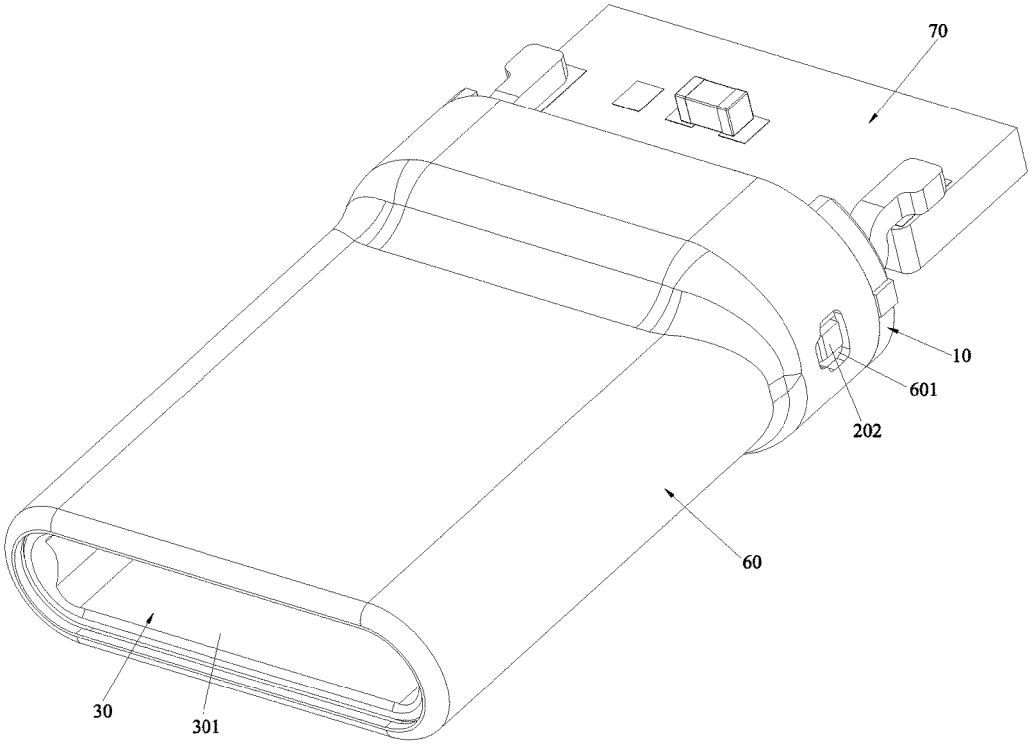
FIG. 2 is another perspective view of the Type-c connector wherein the rear shield enclosure is eliminated.
Figure 3:
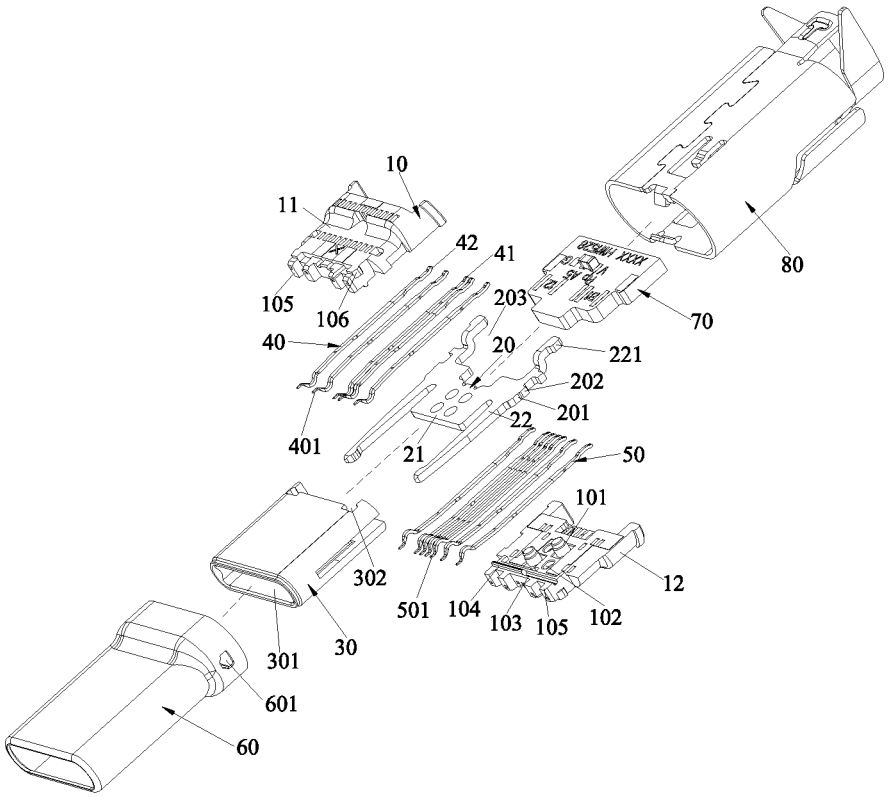
FIG. 3 is an exploded view of the Type-c connector.
Figure 4:
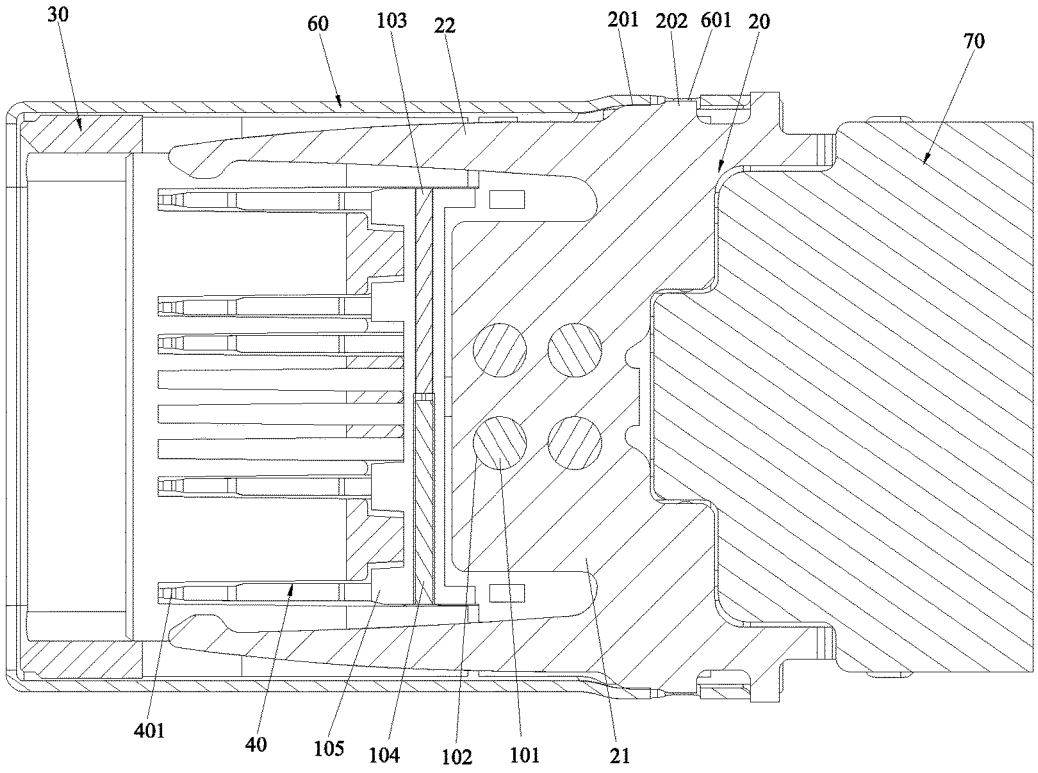
FIG. 4 is a transverse cross-sectional view of the Type-c connector.
Figure 5:
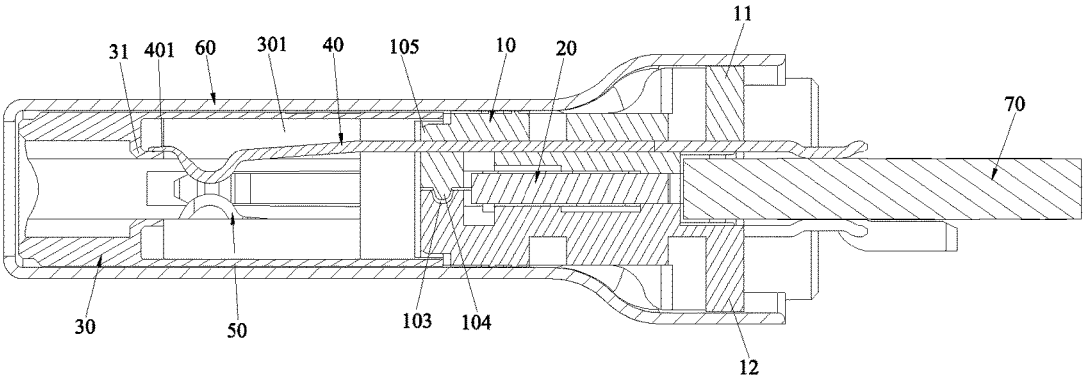
FIG. 5 is a lengthwise cross-sectional view of the Type-c connector.

Referring to FIG. 1 through FIG. 5, according to one preferred embodiment of the present invention, a Type-c connector comprises a main insulator 10, a hook member 20, a housing 30, an upper row of terminals 40, a lower row of terminals 50, and a shield casing 60.

The main insulator 10 comprises an upper insulating member 11 and a lower insulating member 12. The upper insulating member 11 and the lower insulating member 12 are combined together in a vertically symmetrical manner. Particularly, the upper insulating member 11 and the lower insulating member 12 are combined and positioned by means of their positioning posts 101 and positioning holes 102. The upper insulating member 11 and the lower insulating member 12 have their front ends engaged with each other by means of their water seal troughs 103 and water seal strips 104. Particularly, the lower insulating member 12 has its top formed with a water seal trough 103 and a water seal strip 104 at two sides of its front end while the upper insulating member 11 has its bottom formed with a water seal strip 104 and water seal trough 103 at two sides of its front end. The water seal troughs 103 and the corresponding water seal strips 104 are configured to engage with and position each other. With the water seal troughs 103 and the water seal strips 104, the creepage distances between the terminals and the hook member 20 are increased, thereby reducing the risk of short circuit caused by electrolyte creepage. Each of the upper insulating member 11 and the lower insulating member 12 has its front end extended outward to form a creepage portion 105. The creepage portion 105 is to be inserted into the rear end of the socket 301. With the creepage portion 105, the creepage distances between the terminals and the shield casing 60 are increased, thereby reducing the risk of short circuit caused by electrolyte creepage.

The hook member 20 is located between the upper insulating member 11 and the lower insulating member 12. The hook member 20 comprises a motherboard portion 21 and two hook portions 22. Each of the two hook portions 22 has its rear end formed with a raised abutting point 201, and the hook portions 22 are configured to come into close fit with two opposite inner walls of the shield casing 60. The hard interference between the abutting points 201 and the shield casing 60 ensures stable contact between the hook member 20 and the shield casing 60. Each of the two hook portions 22 has its rear end extended rearward to form a weld portion 221. The weld portions 221 jut out of the rear end of the main insulator 10 and are welded with the circuit board 70. The hook member 20 is welded onto the circuit board 70 for grounding, so that the shield casing 60 can provide its shield effect. Each of the two hook portions 22 has its rear end further integratedly formed with a bump 202 right behind the abutting point 201. Correspondingly, the shield casing 60 has its two opposite inner walls formed with notches 601 so that the bumps 202 and the notches 601 can engage with each other. The hook member 20 further has its rear end formed with a trapezoidal notch 203. Correspondingly, the circuit board 70 has a trapezoidal front end to fit and engage with the trapezoidal notch 203.

The housing 30 is assembled to the front end of the main insulator 10. Particularly, the upper insulating member 11 and the lower insulating member 12 have their front ends each provided with raised portions 106 at its two opposite sides. The raised portions 106 are located at the rear ends of the creepage portions 105. Correspondingly, the housing 30 has its upper and lower walls each provided with open notches 302 at two opposite sides thereof. The notch 302 and the raised portion 106 are configured to fit and engage with each other. The housing 30 has its front end formed with a socket 301 extending rearward. The two hook portions 22 have their front ends inserted into the socket 301 and located at two opposite sides of the socket 301. The socket 301 has its front end formed with a plurality of spaced mounting tables 31 at its upper and lower inner walls.

The upper row of terminals 40 and the upper insulating member 11 are fixedly combined, while the lower row of terminals 50 and the lower insulating member 12 are fixedly combined. The contact portions 401 at the front end of the upper row of terminals 40 and the contact portions 501 at the front end of the lower row of terminals 50 each abut against the corresponding mounting tables 31, so that the upper row of terminals 40 and the lower row of terminals 50 are preloaded, making the terminals spring up uniformly, so as to prevent pin breakage that would otherwise happen during male-female connection due to exposure of terminals.

The shield casing 60 encloses the main insulator 10 and the housing 30 from outside, and the shield casing 60 has its rear end enclosed by a rear shield enclosure 80.

The disclosed connector is assembled through the following steps:

1. combining the upper row of terminals 40 and the upper insulating member 11 together, and combining the lower row of terminals 50 and the lower insulating member 12 together;
2. sandwiching the hook member 20 between the upper insulating member 11 and the lower insulating member 12, and combining the upper insulating member 11 and the lower insulating member 12 together;
3. inserting the housing 30 to the front end of the main insulator 10;
4. inserting the circuit board 70 into the trapezoidal notch 203 of the hook member 20;
5. enclosing the main insulator 10 the housing 30 within the shield casing 60; and
6. enclosing the shield casing 60 within the rear shield enclosure 80.

What is claimed is:

1. A Type-c connector with improved performance comprising a main insulator, a hook member, a housing, an upper row of terminals, a lower row of terminals, and a shield casing; the main insulator including an upper insulating member and the lower insulating member, the upper insulating member and the lower insulating member being combined together in a vertically symmetrical manner; the hook member being located between the upper insulating member and the lower insulating member, the hook member including a motherboard portion and two hook portions; the housing being assembled to a front end of the main insulator, the housing having its front end formed with a socket extending rearward, for the two hook portions to have their front ends inserted into the socket and located at two opposite sides of the socket; the upper row of terminals and the upper insulating member being fixedly combined, the lower row of terminals and the lower insulating member being fixedly combined; the shield casing enclosing the main insulator and the housing from outside; the Type-c connector being characterized in:

the upper insulating member and the lower insulating member having their front ends combined by water seal troughs and water seal strips configured to fit and engage with each other, the upper insulating member and the lower insulating member having their front ends each provided with a creepage portion integratedly extended forward, the creepage portion being configured to be inserted into a rear end of the socket; each of the two hook portions having its rear end formed with a raised abutting point, the hook portions being configured to come into close fit with two opposite inner walls of the shield casing, each of the two hook portions having its rear end extended rearward to form a weld portion, the weld portions jutting out of the rear end of the main insulator and being welded with a circuit board; the socket having its front end formed with a plurality of spaced mounting tables at its upper and lower inner walls, and contact portions at the front end of the upper row of terminals and the contact portions at the front end of the lower row of terminals abutting against the corresponding mounting tables, respectively.

2. The Type-c connector of claim 1, wherein the lower insulating member has its top formed with one said water seal trough and one said water seal strip at two sides of its front end while the upper insulating member has its bottom formed with one said water seal strip and one said water seal trough at two sides of its front end, in which the water seal troughs and the corresponding water seal strips are configured to engage with and position each other.

3. The Type-c connector of claim 1, wherein the upper insulating member and the lower insulating member have their front ends each provided with raised portions at its two opposite sides, and the raised portions are located at the rear ends of the creepage portions, while the housing correspondingly have its upper and lower walls each provided with open notches at two opposite sides thereof, in which the notch and the raised portion are configured to fit and engage with each other.

4. The Type-c connector of claim 1, wherein the upper insulating member and the lower insulating member are combined and positioned by means of their positioning posts and positioning holes.

5. The Type-c connector of claim 1, wherein each of the two hook portions has its rear end further integratedly formed with a bump extending outward and right behind the abutting point, while correspondingly, the shield casing has its two opposite inner walls formed with notches so that the bumps and the notches engage with each other.

6. The Type-c connector of claim 1, wherein the hook member has its rear end formed with a trapezoidal notch, while correspondingly, the circuit board has a trapezoidal front end to fit and engage with the trapezoidal notch.

7. The Type-c connector of claim 1, wherein the shield casing has its rear end enclosed by a rear shield enclosure.

* * * * *